United States Patent [19]

Docherty et al.

[11] Patent Number: 4,818,222

[45] Date of Patent: Apr. 4, 1989

[54] SEALED ROTARY HEARTH FURNACE

[75] Inventors: James P. Docherty, Carnegie; Beverly E. Johnson, Pittsburgh, both of Pa.

[73] Assignee: Salem Furnace Co., Pittsburgh, Pa.

[21] Appl. No.: 206,575

[22] Filed: Jun. 14, 1988

[51] Int. Cl.[4] ..... F27B 9/16

[52] U.S. Cl. ..... 432/138; 432/242; 432/139

[58] Field of Search ..... 432/136, 137, 138, 139, 432/242, 115

[56] References Cited

U.S. PATENT DOCUMENTS

| | | | |
|---|---|---|---|
| 3,763,011 | 10/1973 | Allred | 432/138 |
| 4,207,061 | 6/1980 | Ikenoga et al. | 432/138 |
| 4,449,924 | 5/1984 | Ceretti | 432/138 |

*Primary Examiner*—Henry C. Yuen

*Attorney, Agent, or Firm*—Webb, Burden, Ziesenheim & Webb

[57] ABSTRACT

The furnace has a hearth which rotates inside a stationary closed chamber and is supported therein on circumferentially spaced rollers the shafts of which extend outside the furnace and are cantilevered in bearings. The shafts are sealed to the furnace wall by mechanical and pressurized gas sealing means. The charge is deposited through the furnace roof on the rim of the hearth as it rotates and is moved toward the center of the hearth by rabbles. Externally generated hot gases are introduced into the furnace chamber below the hearth and rise through perforations in the hearth and up through the charge. Exhaust gases are withdrawn through the furnace roof. Treated charge drops from a center outlet on the hearth into a soaking pit which extends downwardly through the furnace floor to which it is also sealed.

8 Claims, 4 Drawing Sheets

SEALED ROTARY HEARTH FURNACE

FIELD OF THE INVENTION

This invention relates to rotary furnaces for drying and heating particulate material such as coal, coke, grain and the like in controlled atmospheres. It is more particularly concerned with such a furnace which does not require a single continuous seal around the circumference located on the sidewall to separate the furnace enclosure from the atmosphere.

BACKGROUND OF THE INVENTION

Rotary hearth furnaces for the heating of particulate material in controlled atmospheres are well known and are described in Kemmerer, et al. U.S. Pat. No. 3,470,078 of Sept. 30, 1969 and Oleszko, U.S. Pat. No. 3,652,426 of Mar. 28, 1972. A stationary hearth rotary roof furnace for that purpose is disclosed in Johnson, et al. U.S. Pat. No. 4,669,977 of June 2, 1987. A disadvantage of both types of furnace where the atmosphere must be controlled is the seal between the hearth and furnace chamber or between the roof and furnace chamber. Hearth diameters of 25 feet are not uncommon and the extent of the seal required for such furnaces limits the sealing material to a granular substance such as sand or to a liquid, generally water. A liquid seal can be made quite effective; however, water reacts with some of the gases evolved when coal is heated under controlled conditions. The rotary hearth of our invention is totally enclosed and sealed.

SUMMARY OF THE INVENTION

Our furnace to be described in detail hereinafter has a stationary cylindrical sidewall, a roof affixed thereto and a rotary hearth. The furnace chamber has an imperforate bottom member below the hearth and so is totally enclosed. The hearth rotates on rolls cantilevered on shafts which extend through the sidewall of the chamber into bearings outside the furnace and are sealed to the wall as will be described. Heating gas is injected into the furnace chamber below the hearth and rises through perforations in the hearth into the charge. Spent gas is drawn off through the furnace roof. A feed hopper is mounted on the furnace roof near its circumference to discharge feed material onto the hearth where it is moved toward the center of the hearth as it revolves by rabbles and leaves through a discharge port in the center of the hearth into a soaking pit which extends through the furnace chamber and floor and is sealed thereto

DESCRIPTION OF PREFERRED EMBODIMENTS

Figure 1:
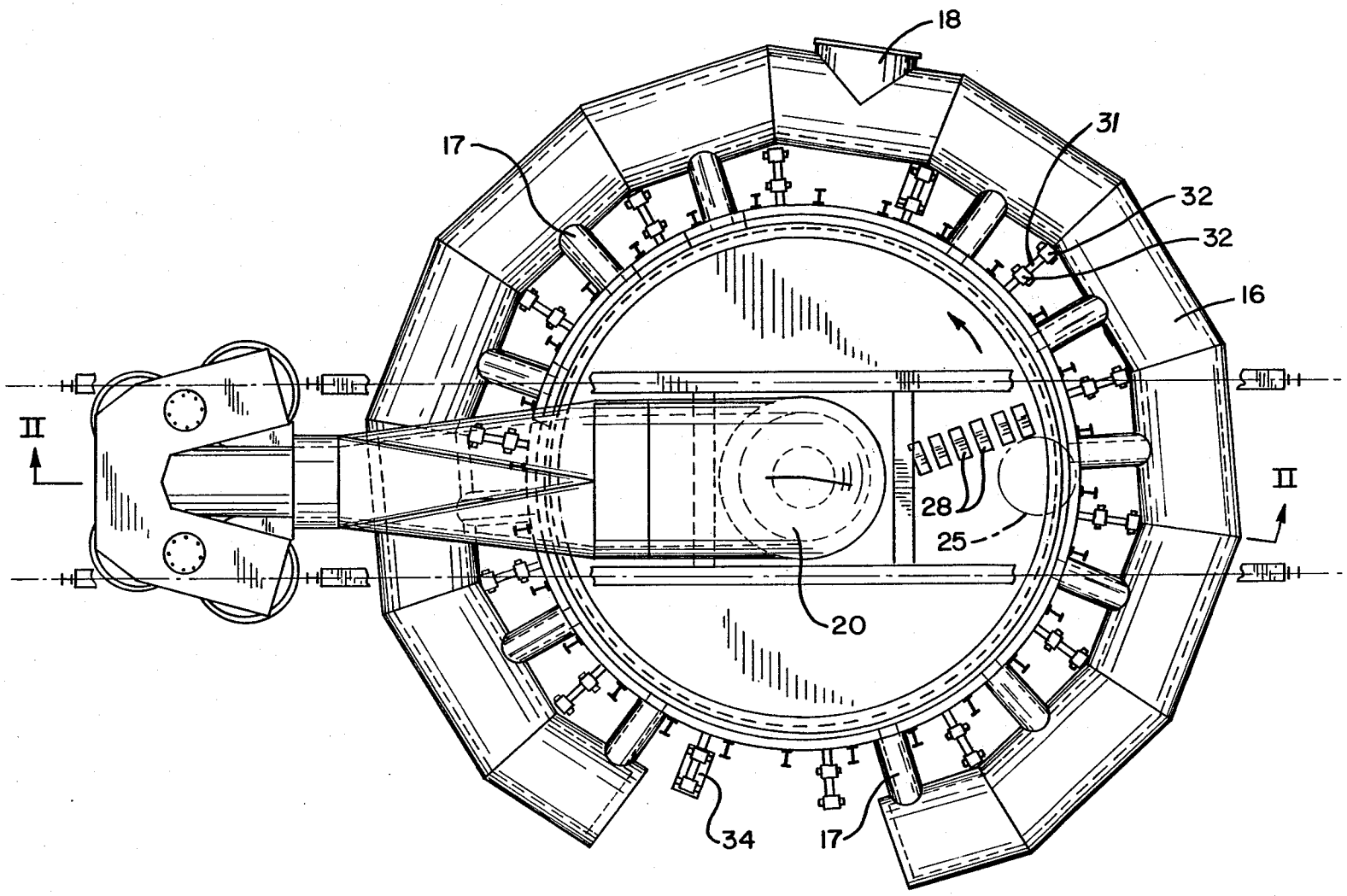
FIG. 1 is a plan of our furnace.
Figure 2:
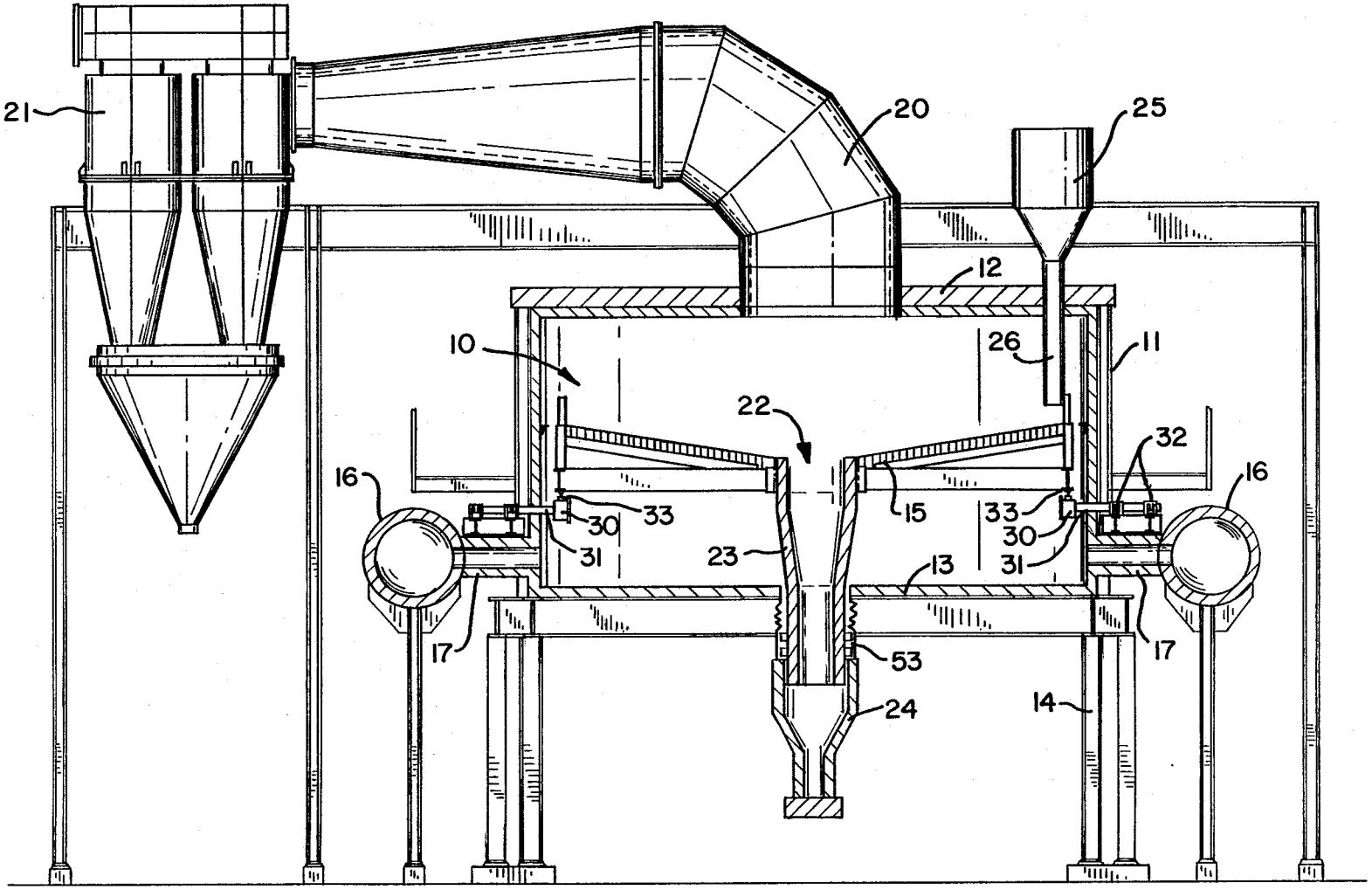
FIG. 2 is a vertical section through first embodiment of the furnace of FIG. 1 taken on the lines II—II.
Figure 3:
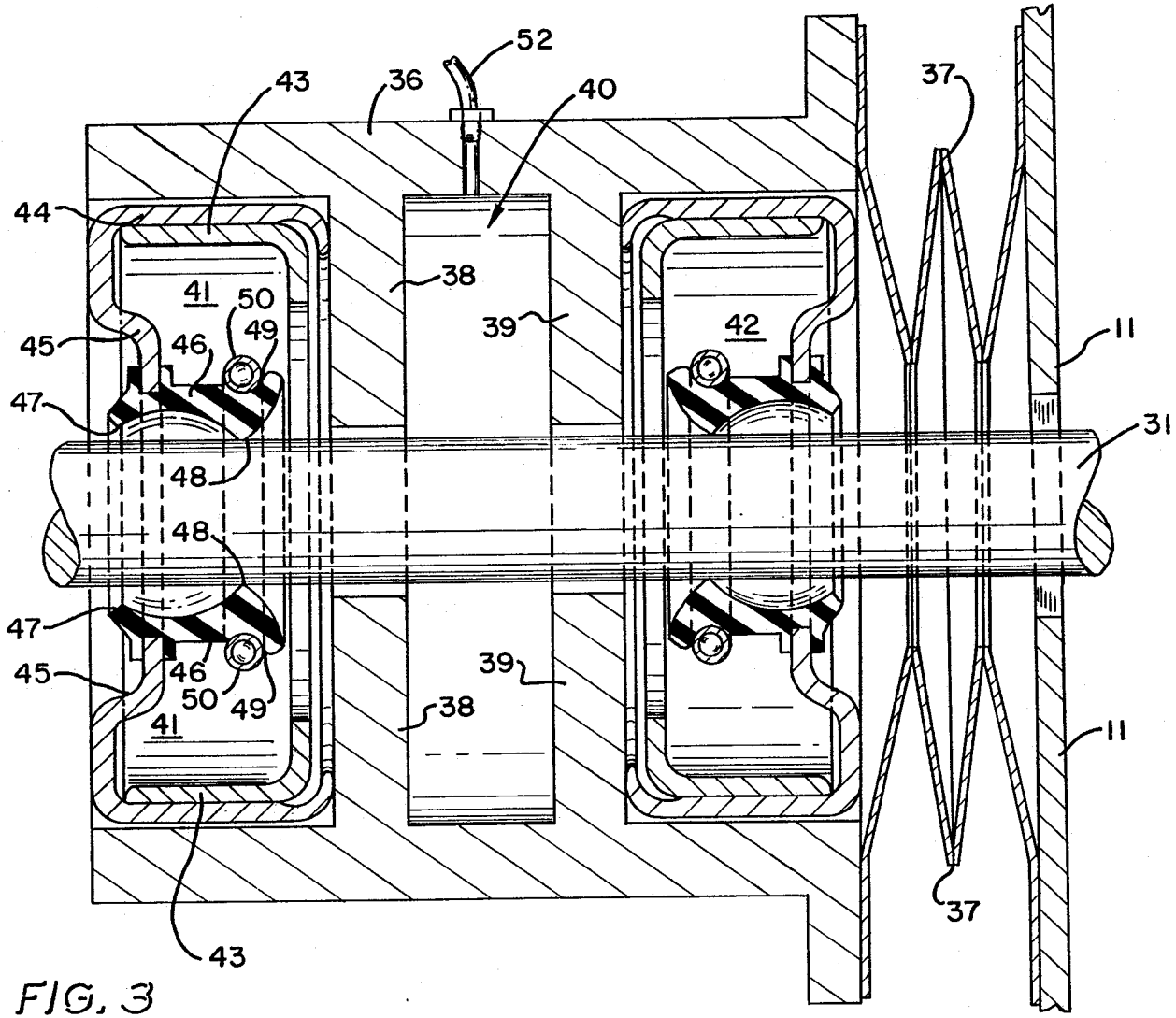
FIG. 3 is a vertical section through a shaft seal.

A first embodiment of our furnace shown in FIGS. 1, 2 and 3 comprises a cylindrical chamber 10 having a wall 11, a stationary flat roof 12 and a stationary floor 13. The structure is supported above ground on framework 14. Within chamber 10 and intermediate roof 12 and floor 13 is a rotary hearth 15 to be described in more detail hereinafter. Chamber 10 is surrounded by a manifold or bustle pipe 16 which supplies hot gas to the chamber through wall 11 by means of a plurality of offtakes 17. Hot gas is delivered to bustle pipe 16 through intake 18 from an external source not shown. The bustle pipe offtakes 17 are located intermediate furnace floor 13 and hearth 15. Hearth 15 is perforated as shown in the above-mentioned Johnson, et al. U.S. Pat. No. 4,669,977 of June 2, 1987, so that hot gases introduced below the hearth rise through the hearth and heat the charge. The exhaust gases are withdrawn from chamber 10 through flue 20 at the center of roof 12 and are passed through cyclones 21 to remove entrained particles therefrom.

Hearth 15 slopes downwardly from its circumference to its center 22 into a cylindrical soaking pit 23 which extends through furnace floor 13 into a stationary delivery chute 24. A feedbin 25 is mounted above furnace roof 12 and delivers charge through pipe 26 to hearth 15 near its circumference. Rabbles 28 mounted in roof 12 are arranged to move the charge in a known manner from the hearth circumference toward the entry 22 of soaking pit 23 as the hearth 15 revolves.

Hearth 15 is supported on an array of flanged rollers 30 around its circumference, each roller being mounted inside chamber 10 on the end of a shaft 31 which extends through furnace wall 11 into bearings 32—32 positioned outside chamber 10. A circular rail 33 affixed to the underside of hearth 15 rides on rollers 33. Certain of the shafts are motor driven as at 34. Alternatively, those shafts may drive pinions which mesh with a conventional ring gear affixed to the underside of hearth 15.

All roller shafts 31 are sealed to the furnace chamber wall 11 as is shown in detail in FIG. 3. A conventional stationary cylindrical seal housing 36 surrounds shaft 31 outside of chamber wall 11. That housing 36 is sealed to chamber wall 11 by an annular metal bellow 37 which accommodates shaft deflection. Housing 36 is divided by two partitions 38 and 39 spaced from each other and clearing shaft 31 into a central chamber 40, an outside chamber 41 at the housing end remote from chamber wall 11, and outside chamber 42 at housing end adjoining chamber wall 11. Chambers 41 and 42 contain identical sealing mechanisms positioned as mirror images. In chamber 41 is a cylindrical element 44 fitting against housing 36 and open toward partition 38. It is held in place by cup-shaped member 43 which fits inside its open end and is partially closed by a flange element 45 at its outside end. Fitted to the end of flange 45 is a cylindrical sealing element 46 of flexible material which extends parallel to shaft 31 both ways from flange 45. Its shorter cylindrical extension away from partition 38 has a lip 47 angling toward shaft 31 but not compressed thereby. Its longer cylindrical extension toward partition 38 has a lip 48 at its free end which contacts shaft 31. The inside face of element 46 opposite lip 48 is a concave annulus 49 and within that annulus is positioned an annular garter spring 50 which surrounds shaft 31 and element 46 so as to urge lip 48 against shaft 31 circumferentially. An inert gas under pressure is introduced into central chamber 40 through inlet 52 and urges element 46 against shaft 31 all in a known manner.

The discharge end of soaking pit 23 is sealed to furnace floor 13 by seal 53 which may be similar to the shaft seal described above, or the conduit seal described hereinafter.

Figure 4:
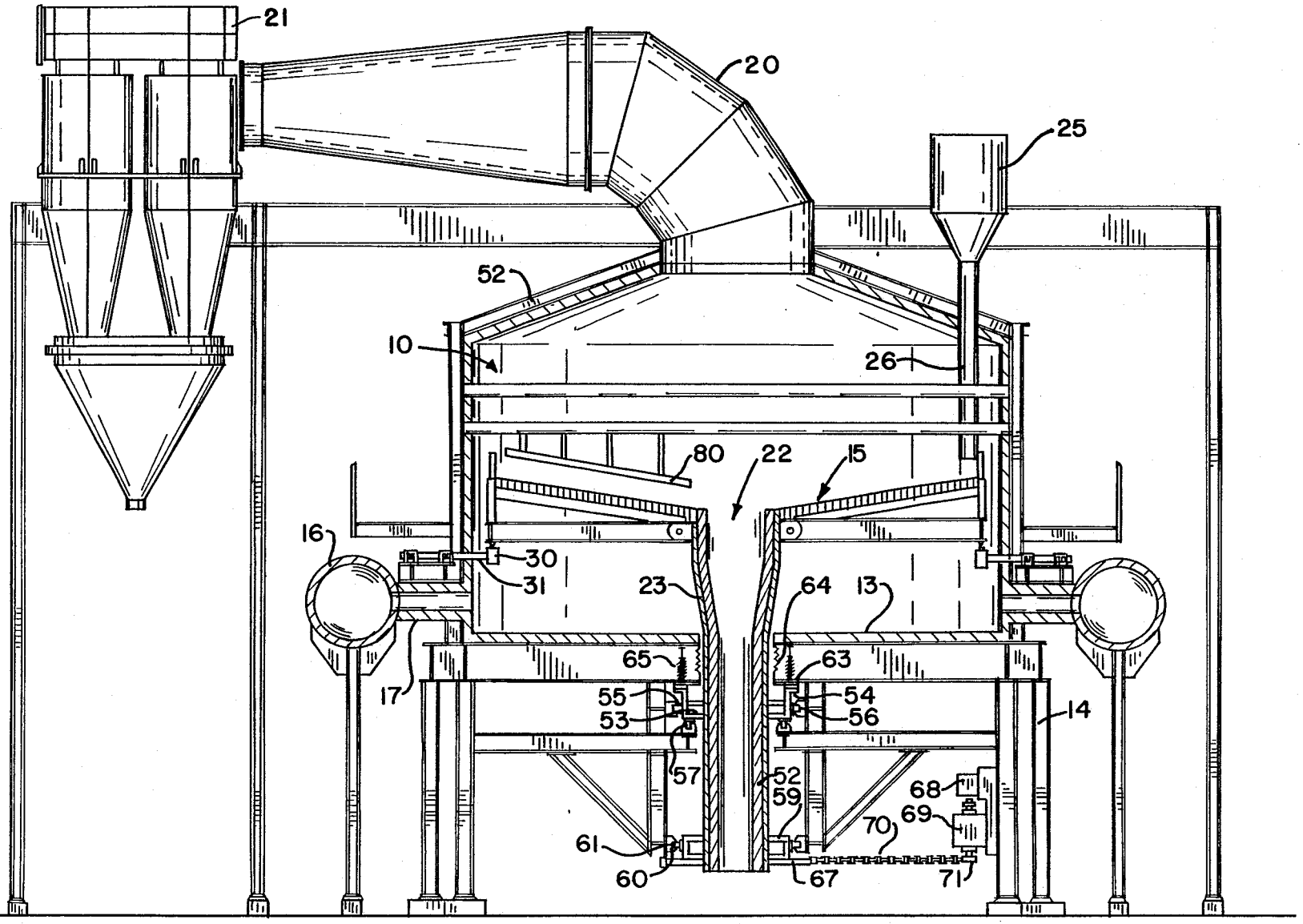
FIG. 4 is a vertical section through a second embodiment of the furnace of FIG. 1 taken along lines II—II.

A second embodiment of our furnace is shown in FIGS. 1, 3 and 4. Furnace chamber 10 differs from that of FIG. 2 in having a frusto-conical roof 52. Where high pressures are required in the furnace chamber such a roof withstands them better than a flat roof 12. Soaking pit 23 is elongated into delivery conduit 52. Below the chamber floor 13 and its structural supporting means 14 conduit 52 has affixed thereto an annular member with a flat annular lower face 53 through which conduit 52 extends, a cylindrical wall 54 spaced from conduit 52 and an outwardly extending flange 55 around the upper end of wall 54. A flat flexible metal plate 63 connected by metallic bellows 64 surrounding the upper end of conduit 52 to chamber floor 53 is held against flange 55 by spring-urged vertical members 65 mounted in the structural framework 14 below chamber floor 13. Conduit 52 is thus sealed to furnace chamber 10. A thrust bearing 56 supported by the external structural member 14 encircles cylindrical wall 54. Load-carrying bearings 57 also supported by structural members 14 bear against lower face 53 previously mentioned. Near the lower end of conduit 52 is fixed an annular member 59 with a cylindrical outer face 60 surrounded by a thrust bearing 61. A sprocket 67 is affixed to the lowermost portion of conduit 52 below thrust bearing 61. A motor 68 and speed reducer 69 are mounted with shafts vertical on the supporting framework 14 which speed reducer has a drive sprocket 71 aligned with sprocket 67 and connected therewith with sprocket chain 70.

The furnace of FIG. 4 is otherwise the same as that of FIG. 3.

In the operation of our apparatus, the material to be treated is loaded into the feedbin 25 and discharged through pipe 26 onto the hearth 15 at its outer edge. Hearth 15 rotates about the vertical axis through its center on circumferentially disposed rollers 30 which make rolling contact with circular rail 33. Roller shafts 31 extend outwardly through furnace wall 11 into bearings 32 outside the furnace chamber. Each shaft 31 is sealed with furnace wall 11 by the sealing means described hereinabove which apply mechanical pressure to the sealing element 46 through garter spring 50 and also through pressurized gas introduced into bearing housing 36. Heating gas introduced into the furnace chamber below hearth 15 through manifold 16 and offtakes 17 rises through perforations in the hearth into the charge. As the hearth rotates, rabbles 28 suspended above hearth 15 move the charge toward discharge port 22 and out of our furnace through soaking pit 23.

A levelling rake 80, FIG. 4, is also preferably employed and is positioned rearwardly from the rabbles in the form of a straight bar parallel to the hearth. The levelling rake impinges upon the top of the charge to smooth the furrows formed by the rabbles to thereby improve gas distribution through the bed by establishing a uniform bed height.

In the foregoing specification we have set out certain preferred embodiments and practices of our invention; however, it will be understood that this invention may be otherwise embodied within the scope of the following claims.

Having thus described our invention with the detail and particularity required by the Patent Laws, what is claimed and desired to be protected by Letters Patent is set forth in the following claims.

We claim:

1. In a rotating hearth furnace for heating particulate material comprising a stationary wall and roof, means in said roof for charging particulate material onto said hearth, means in said wall for supplying hot gases to said particulate material, a soaking pit opening from the center of said hearth for discharge of said particulate material and rabbles mounted in said roof, the improvement comprising:

a floor below said hearth affixed to said wall to form a closed chamber, supporting rollers for said hearth positioned intermediate said hearth and said floor, a horizontal shaft affixed to each said supporting roller extending through said wall and cantilevered in bearing mounted outside said wall, shaft sealing means between each said shaft and said wall, means outside said wall for rotating said hearth, means for supplying hot gases to said chamber below said hearth and perforations in said hearth admitting said hot gases therethrough.

2. Apparatus of claim 1 in which said shaft sealing means are positioned intermediate said wall and said bearing.

3. Apparatus of claim 1 in which said shaft sealing means comprise a housing having a central annular chamber, outer chambers at each end connecting with said central chamber, flexible sealing means in each said outer chamber urged against said shaft by spring means, and means for introducing an inert gas under pressure into said center chamber so as to assist in urging said flexible means against said shaft.

4. Apparatus of claim 1 including rotatable sealing means between said soaking pit and said furnace floor.

5. Apparatus of claim 1 including a circular track affixed to the underside of said hearth and resting on said supporting rollers.

6. Apparatus of claim 1 in which said soaking pit extends through said floor into a delivery conduit, and including bearing means below said floor in which bearing means said delivery conduit rotates and in which said means outside of said hearth for rotating said hearth are connected with said delivery conduit so as to cause it to rotate.

7. Apparatus of claim 6 in which said rotating means connected with said delivery conduit comprise a gear rack affixed to said delivery conduit, and a pinion gear affixed to said rotating means.

8. Apparatus of claim 1 including a levelling rake positioned generally parallel to the hearth and rearwardly of said rabbles for smoothing a top surface portion of said charge material.

* * * * *

UNITED STATES PATENT AND TRADEMARK OFFICE

CERTIFICATE OF CORRECTION

PATENT NO. : 4,818,222

DATED : April 4, 1989

INVENTOR(S) : James P. Docherty and Beverly E. Johnson

It is certified that error appears in the above-identified patent and that said Letters Patent is hereby corrected as shown below:

In the Abstract Line 4 after "furnace" insert --wall--.

Column 1 Line 17 "3,470,078" should read --3,470,068--.

Signed and Sealed this

Fourteenth Day of November, 1989

*Attest:*

JEFFREY M. SAMUELS

*Attesting Officer* *Acting Commissioner of Patents and Trademarks*